US006672906B1

(12) United States Patent
Kimura

(10) Patent No.: US 6,672,906 B1
(45) Date of Patent: Jan. 6, 2004

(54) JACK DEVICE

(75) Inventor: Satoru Kimura, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 10/018,135

(22) PCT Filed: Jun. 21, 2000

(86) PCT No.: PCT/JP00/04041

§ 371 (c)(1),
(2), (4) Date: Apr. 17, 2002

(87) PCT Pub. No.: WO00/79653

PCT Pub. Date: Dec. 28, 2000

(30) Foreign Application Priority Data

Jun. 24, 1999 (JP) ..... 11/178316

(51) Int. Cl.[7] ..... H01R 24/04
(52) U.S. Cl. ..... 439/668; 439/669
(58) Field of Search ..... 439/668, 669, 439/188, 924.1

(56) References Cited

U.S. PATENT DOCUMENTS

| | | | | |
|---|---|---|---|---|
| 3,108,843 A | | 10/1963 | Frantz | |
| 3,166,649 A | | 1/1965 | Frantz | |
| 4,368,941 A | | 1/1983 | Martin | |
| 4,659,167 A | * | 4/1987 | Masuda | 439/668 |
| 5,522,738 A | * | 6/1996 | Lace | 439/669 |

FOREIGN PATENT DOCUMENTS

| | | |
|---|---|---|
| JP | 47-28913 | 11/1972 |
| JP | 54-12990 | 6/1979 |
| JP | 62-79377 | 5/1987 |
| JP | 63-6500 | 1/1988 |
| JP | 63-63985 | 4/1988 |
| JP | 5-69877 | 9/1993 |
| JP | 6-140106 | 5/1994 |

* cited by examiner

*Primary Examiner*—Ross Gushi
(74) *Attorney, Agent, or Firm*—McDermott, Will & Emery

(57) ABSTRACT

A jack device which does not malfunction because of overcurrent in an apparatus or a device that is connected to the jack device by preventing short-circuit between contacts in inserting a plug. The jack device, into which a single-head plug (50) having plug poles in the direction of insertion is inserted for connection, has a contact piece (11) that is arranged at the end of plug (50) and brought into contact with a first plug pole (plug pole 54) and contact piece (10) that is arranged neighboring the first plug pole and brought into contact with a second plug pole (plug pole 52). To widen the spacing between the two plug contact pieces (11), (10) in the direction of plug insertion, the spacing D between the plug connecting parts (11*p*), (10*p*) of both contact pieces (11), (10) is almost equal to or greater that the length L of the first plug pole (plug pole 54), so that when the first plug pole (plug pole 54) contact with the inside contact piece (11), the contact piece (10) on the inlet side contacts with the second plug pole (plug pole 52).

12 Claims, 8 Drawing Sheets

JACK DEVICE

TECHNICAL FIELD OF THE INVENTION

The present invention relates to a jack device for connecting a headphone to be used on a passenger seat of an airplane, for example, in particular to the structure of contacting parts with a plug.

BACKGROUND OF THE TECHNOLOGY

In recent aircrafts, an entertainment system is installed to provide music and movie entertainment to passengers. In such a system, individual passengers can listen to selected music or movie audio through a headphone installed on each passenger seat.

In order to improve the sound quality of such an entertainment system, noise-reduction type headphones are increasingly used. A noise reduction type headphone is one in which a noise is cancelled with a sound having a phase opposite to that of the noise. Left and right sound signals as well as DC power are supplied to this type of headphones.

In this type of headphones, three single-head plugs each having plural (mainly two) plug poles are normally used. These plugs are inserted into a jack device provided on a passenger seat for connection. A passenger can listen to desired audio through this connection.

FIG. 10 is an external appearance of a jack device for a conventional headphone. As is illustrated in FIG. 11, the jack device comprises case 200 and cable 26 having a connecting member for connection with a central apparatus of an entertainment system. Case 200 comprises upper case 21 and lower case 22 and is provided with three jack sections (23, 24, 25). Of the three jack sections (23, 24, 25), jack section 23 is for supplying DC power, and the other two jack sections (24, 25) are used for left and right sounds. A single-head plug having plural plug poles is inserted into the inlet port of a jack section to a predetermined position. With this, connection of the single-head plug with the jack section is performed. Cable 26 extends out from case 200 for connection with a central apparatus of an entertainment system.

Inside cases 21, 22 of the jack device, substrates 27, 28, 29 are provided for each respective jack sections 23, 24, and 25 as illustrated in FIG. 11. Each of substrates 27, 28, 29 is soldered to corresponding jack sections 23, 24, 25. Lead wires contained in cable 26 are connected to each of the substrates 27, 28, 29.

A single-head plug is inserted into each of the jack sections 23, 24, 25 as described earlier. Each of these plugs has plural plug poles in the direction of insertion.

Referring to FIG. 12 and FIG. 13 and taking jack section 23 as an example, a description will now be given below on the structure of jack section 23 and the plug to be inserted into it. FIG. 12 shows the cross section of jack section 23.

Jack section 23 for supplying DC power comprises:

a. base 34 having opening 34*a* for insertion of a plug;

b. movable contact piece 31 as a first contact piece with the plug;

c. grounding spring 30 as a second contact piece with the plug;

d. fixed piece 32; and e. hollow holder 33 for affixing movable contact piece 31, grounding spring 30, and fixed piece 32.

The structure of the other jack sections 24, 25 is approximately the same as the structure of jack section 23 for supplying DC power.

For example, FIG. 13 is an illustration of a state in which single-head plug 50 has been inserted halfway into jack section 23. Plug 50 has plural plug poles (two plug poles in FIG. 13) in the direction of insertion. As illustrated in FIG. 13, plug 50 comprises plug pole 54 as a first plug pole disposed at the front end of the plug, plug 52 as a second plug pole disposed adjacently to plug pole 54, and insulating collar 56 between plug pole 54 and plug pole 52.

When plug 50 is inserted into jack section 23, plug pole 54 is first brought into contact with grounding spring 30. As plug 50 is further inserted, plug pole 54 is brought into contact with movable contact piece 31.

In conventional jack devices of this type, the spacing (DB in FIG. 12) between movable contact piece 31 and grounding spring 30 on the inlet side is relatively small. As a result, as illustrated in FIG. 13, there occurs a case where plug pole 54 on the front end of the plug is simultaneously brought into contact with movable contact piece 31 and grounding spring 30 in the middle of insertion of plug 50, namely, a state in which plug 50 has been inserted halfway. In the event such simultaneous contact occurs, movable contact piece 31 and grounding spring 30 are short-circuited through plug pole 54.

In such a case, if the jack section is one for supplying a relatively small current such as an audio current, no serious trouble is caused. However, if the jack section is for supplying DC power, the following difficulty will be caused.

Short circuit of contact pieces for DC power inside a jack device will cause an overcurrent in a DC power supply unit of a central apparatus of an entertainment system. The overcurrent may trigger a protection circuit in the central apparatus thus causing suspension of system operation, malfunction or a failure.

DISCLOSURE OF THE INVENTION

The present invention addresses the above-described problems and provides a structure in which plural con tact pieces will not short-circuit in the middle of insertion of a plug. It is an object of the present invention to prevent suspension of operation, malfunction, or failure of an apparatus that is directly or indirectly connected to a jack device.

The present invention provides a jack device into which a single-head plug having plural plug poles in the direction of insertion is inserted for connection, and which comprises:

a base having an opening for insertion of a plug;

a first contact piece that is brought into contact with a first plug pole disposed at the front end of the plug;

a second contact piece that is brought into contact with a second plug pole disposed adjacently to the first plug pole; where the first and the second contact pieces are provided in the direction of plug insertion; and the spacing between the plug-contacting portion of the first contact piece and the plug-contacting portion of the second contact piece is made approximately equal to or greater than the length in the direction of plug insertion of the first plug pole of the plug.

Also, a hollow holder to which the first and the second contact pieces are affixed has a notch. When a plug is inserted, the second contact piece is pushed down toward the notch. The notch makes it possible to make the outer dimensions of a jack device with the above structure equal to the outer dimensions of a conventional jack device.

According to the above-described structure, the spacing between the two contact pieces is greater than the length of the above first plug pole. Accordingly, there will not occur any case in which the two contact pieces are simultaneously brought into contact with the first plug pole provided at the front end of the plug. Consequently, the two contact pieces will not make a short circuit through the first plug pole in the middle of plug insertion. Also, the outer dimensions of a jack device with the above structure can be made equal to the outer dimensions of a conventional jack device while preventing short circuit of the two contact pieces. That is, the jack device of the present invention can be used for a conventional plug without changing its length.

DESCRIPTION OF THE PREFERRED EMBODIMENTS

Preferred Embodiment—1

Referring to drawings, a description will now be given below on a jack device in the first preferred embodiment of the present invention.

Figure 1:
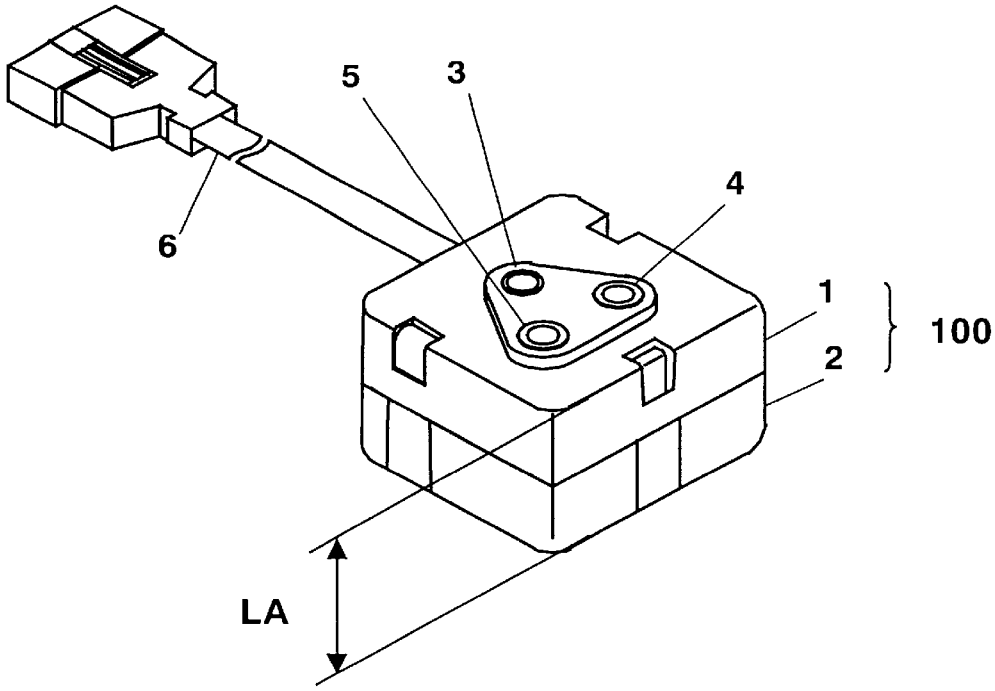
FIG. 1 is a perspective view of a jack device of the present invention.

A jack device in the first preferred embodiment of the present invention will be described below with reference to FIGS. 1 through 5. FIG. 1 is an external view of the jack device in the first embodiment of the present invention.

Figure 2:
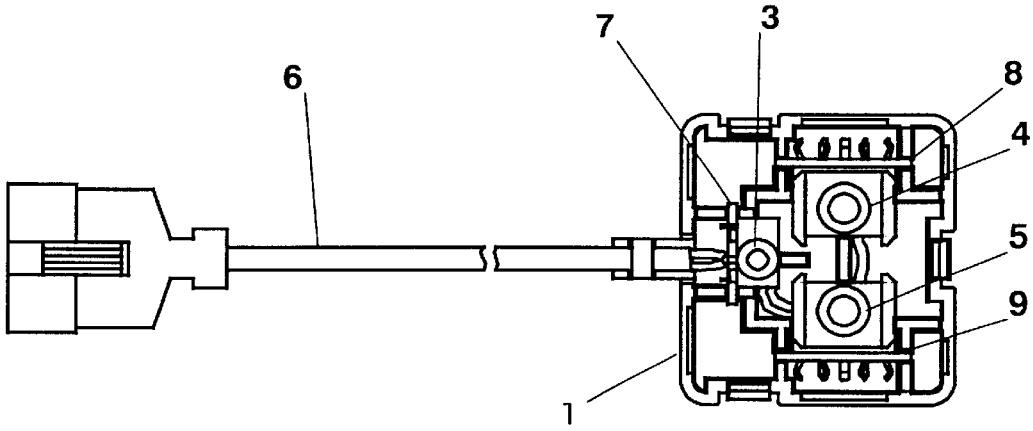
FIG. 2 is a plan view of an entire jack device in a first preferred embodiment of the present invention with the upper part of the case removed to show the inside.

The jack device of the first preferred embodiment has three jack sections for inserting single-head plugs. The single-head plugs to be inserted are provided with plural plug poles in the direction of insertion. As illustrated in FIG. 2, substrates (7, 8, 9) are provided inside case 100 for each respective jack sections (3, 4, 5). Each of the substrates (7, 8, 9) is soldered to the corresponding jack sections (3, 4, 5). Lead wires contained in connecting cable 6 are connected to each of the substrates (7, 8, 9). This structure is not particularly different from the conventional jack devices of this type shown in FIG. 10 and FIG. 11. Also, out of the three jack sections (3, 4, 5), jack section 3 is for supplying DC power. The other two jack sections (4, 5) are used for left and right audio signals.

Figure 3:
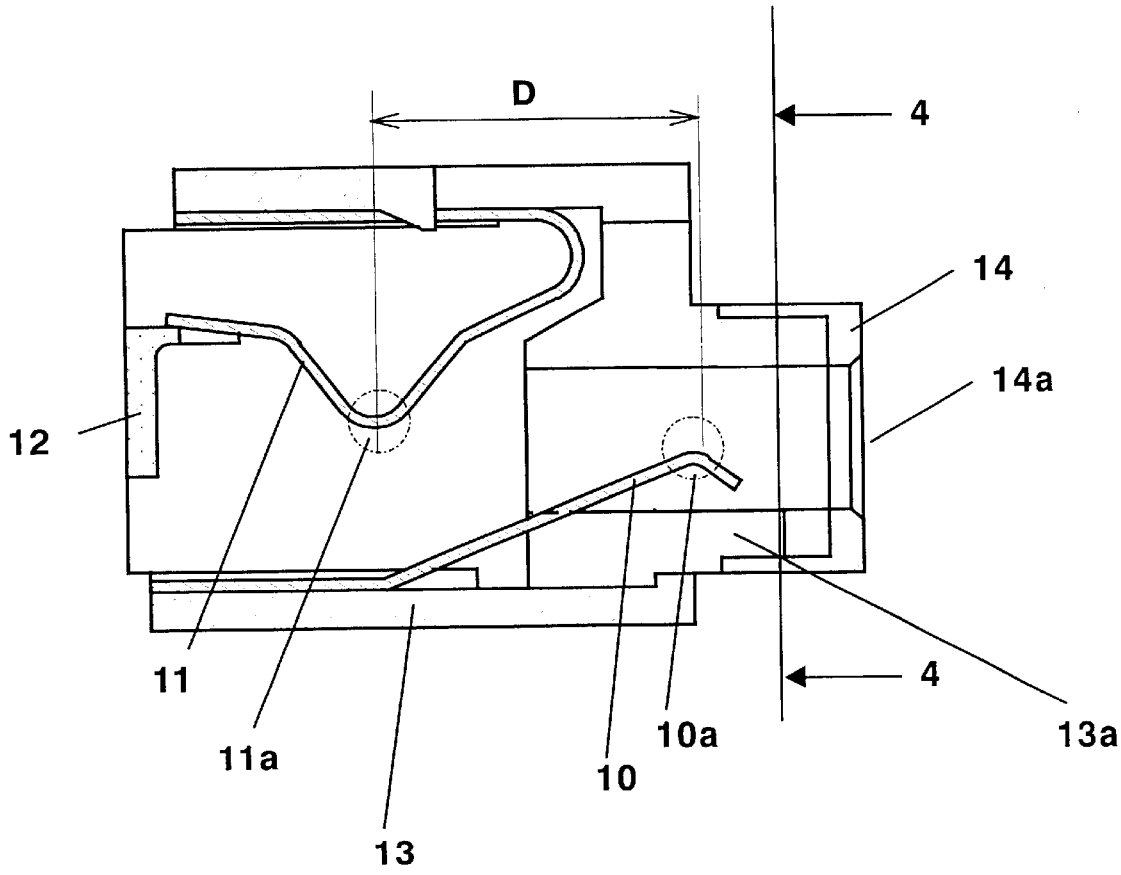
FIG. 3 is an enlarged cross-sectional view of a jack section for supplying DC power, being a part of the jack device, indicating a state before insertion of a plug.
Figure 4:
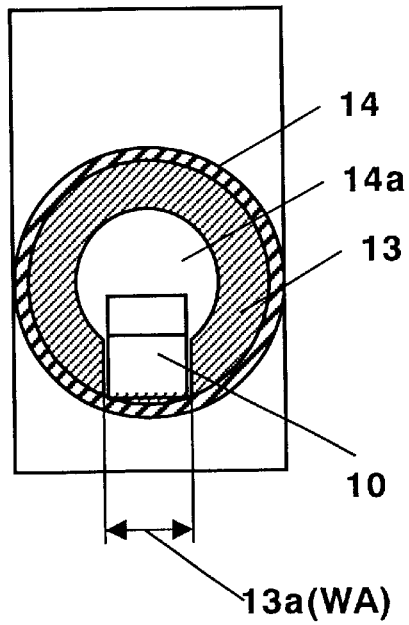
FIG. 4 is a cross-sectional view of the jack device in FIG. 3 taken along the plane 4—4.

Taking jack section 3 for supplying DC power as an example, a description of the jack device of the present invention will be given below. FIG. 3 shows a state before insertion of a plug. FIG. 4 is a cross-sectional view of the jack device in FIG. 3 taken along the plane 4—4.

As illustrated in FIG. 3, jack section 3 for supplying DC power has three contact pieces, namely, movable contact piece 11 as a first contact piece with a plug, grounding spring 10 as a second contact piece with a plug, and a fixed piece 12. These three contact pieces are affixed to hollow holder 13. Also, base 14 having opening 14*a* for reinforcing the entrance of jack section 3 is provided at the entrance of jack section 3. Notch 13*a* having a width WA (ref. FIG. 4) is formed near opening 14*a* of hollow holder 13.

Single-head plug 50 to be inserted has plug poles 52 and 54 in the direction of insertion. Also, insulating collar 56 is provided between plug pole 52 and plug pole 54 for insulating them.

When plug 50 is inserted to a predetermined position from base 14 of jack section 3, grounding spring 10 is brought into contact with plug pole 52 (second plug pole) of plug 50, and movable contact piece 11 is brought into contact with plug pole 54 (first plug pole) at the front end of plug 50.

This state is not different from a jack section for supplying DC power of conventional jack devices of this type.

In jack device 3 of this preferred embodiment, the spacing between the contacting portion of grounding spring 10 (plug contacting portion 10*a*) and the contacting portion of movable contact piece 11 (plug contacting portion 11*a*) is defined as D (shown in FIG. 3). Also, the length of plug pole 54 (first plug pole) at the front end of plug 50 is defined as L (shown in FIG. 5).

In jack device 3 in the present preferred embodiment, the relationship between the spacing D and length L is set as $$D \geq L.$$

A point of difference from conventional jack devices lies in that notch 13*a* is formed close to opening 14*a* of hollow holder 13. Notch 13*a* allows grounding spring 10 to extend to a position close to the entrance of jack section 3.

Figure 12:
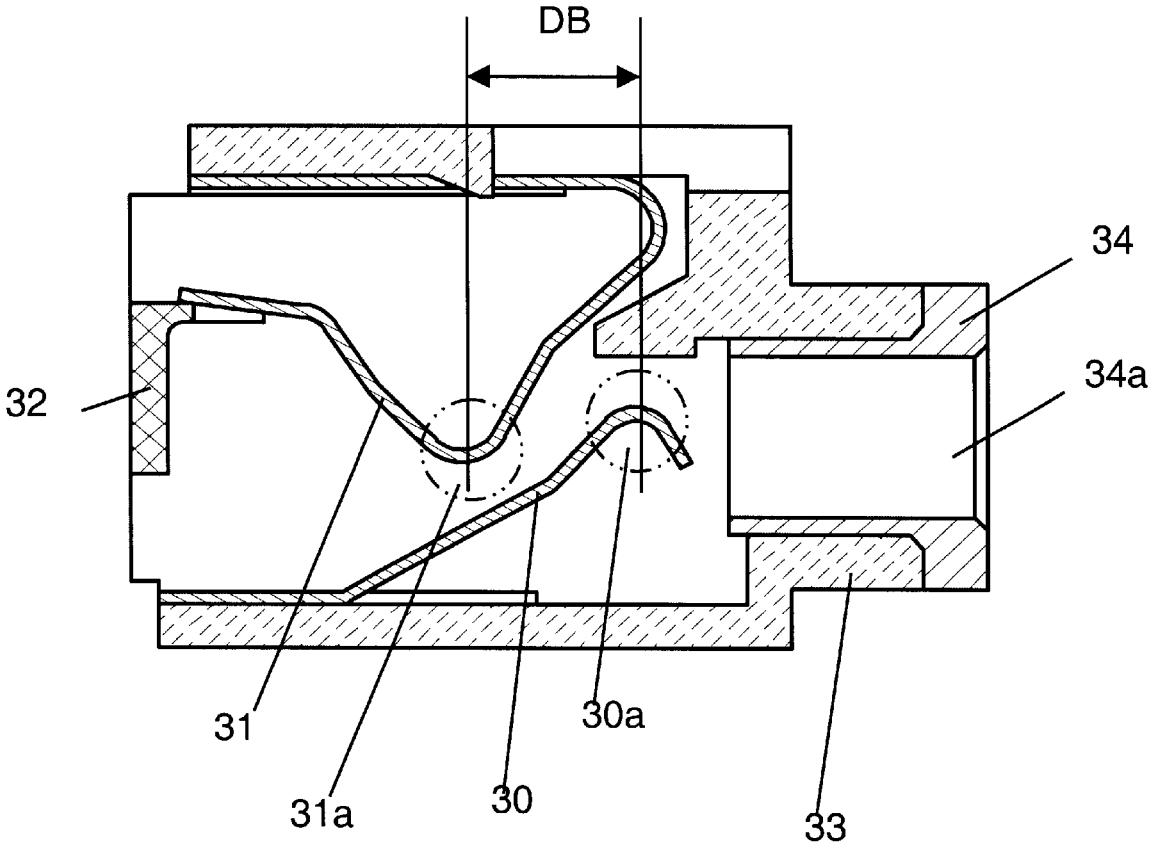
FIG.12 (PRIOR ART)
FIG. 12 is an enlarged cross-sectional view of a jack section, being a part of the above conventional jack device, for supplying DC power showing a state before insertion of a plug.
Figure 13:
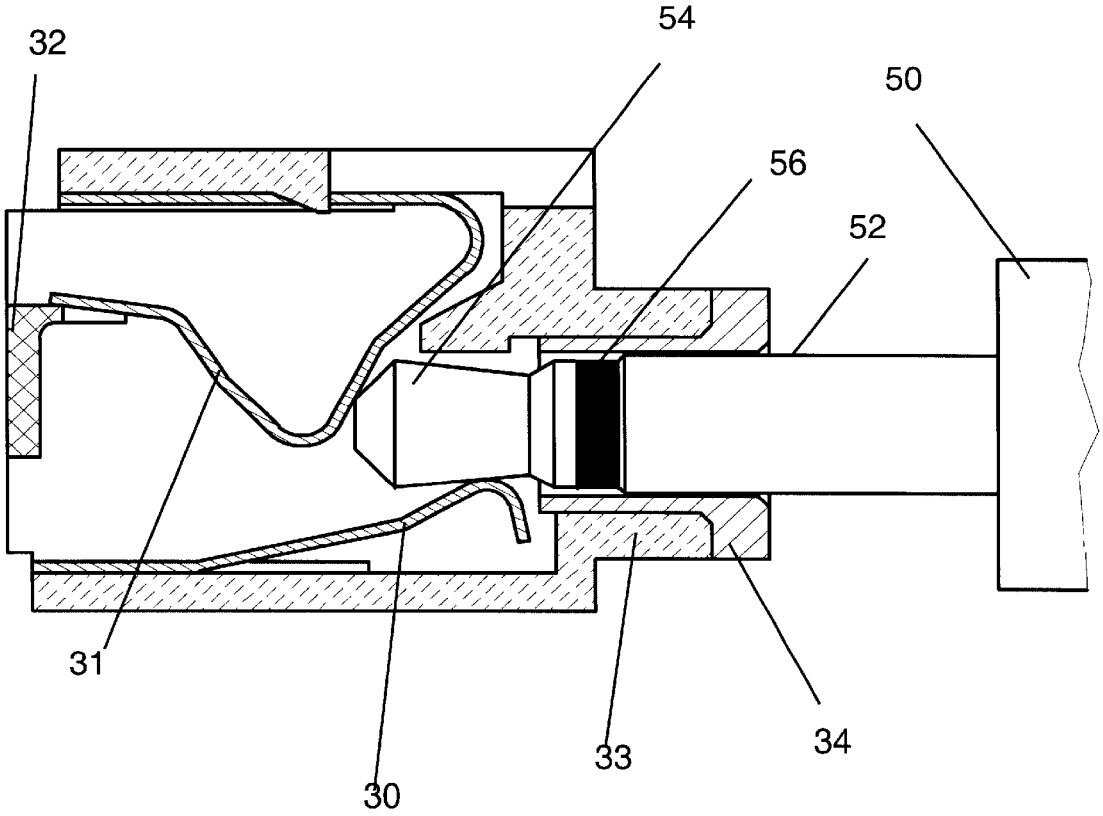
FIG.13 (PRIOR ART)
FIG. 13 is an enlarged cross-sectional view of the above conventional jack section for supplying DC power showing a state in which a plug is inserted halfway.

With this structure, the spacing (for example, D in FIG. 3) between contacting portion 10*a* of grounding spring 10 and contacting portion 11*a* of movable contact piece 11 in the direction of insertion of a plug can be made greater than conventional spacing (for example, DB in FIG. 12). Moreover, the outer dimensions of the jack device (LA in FIG. 1) can be made equal to the outer dimensions of a conventional jack device (LB in FIG. 10). Consequently, by employing this structure, conventional plugs can be used as is without changing their length.

In this case, grounding spring 10 and movable contact piece 11 are elastically deformed due to inserted plug 50. The spacing D between contacting portion 10*a* and contacting portion 11*a* is determined taking the deformation into account.

As exemplified in this preferred embodiment, grounding spring 10, being one of the contact pieces, is deformed by insertion of plug 50 in a manner such that it departs from movable contact piece 11. Accordingly, the spacing D between contacting portions 10*a* and 11*a* when plug 50 is not inserted may be slightly smaller than the length L of plug pole 54 of plug 50.

Figure 5:
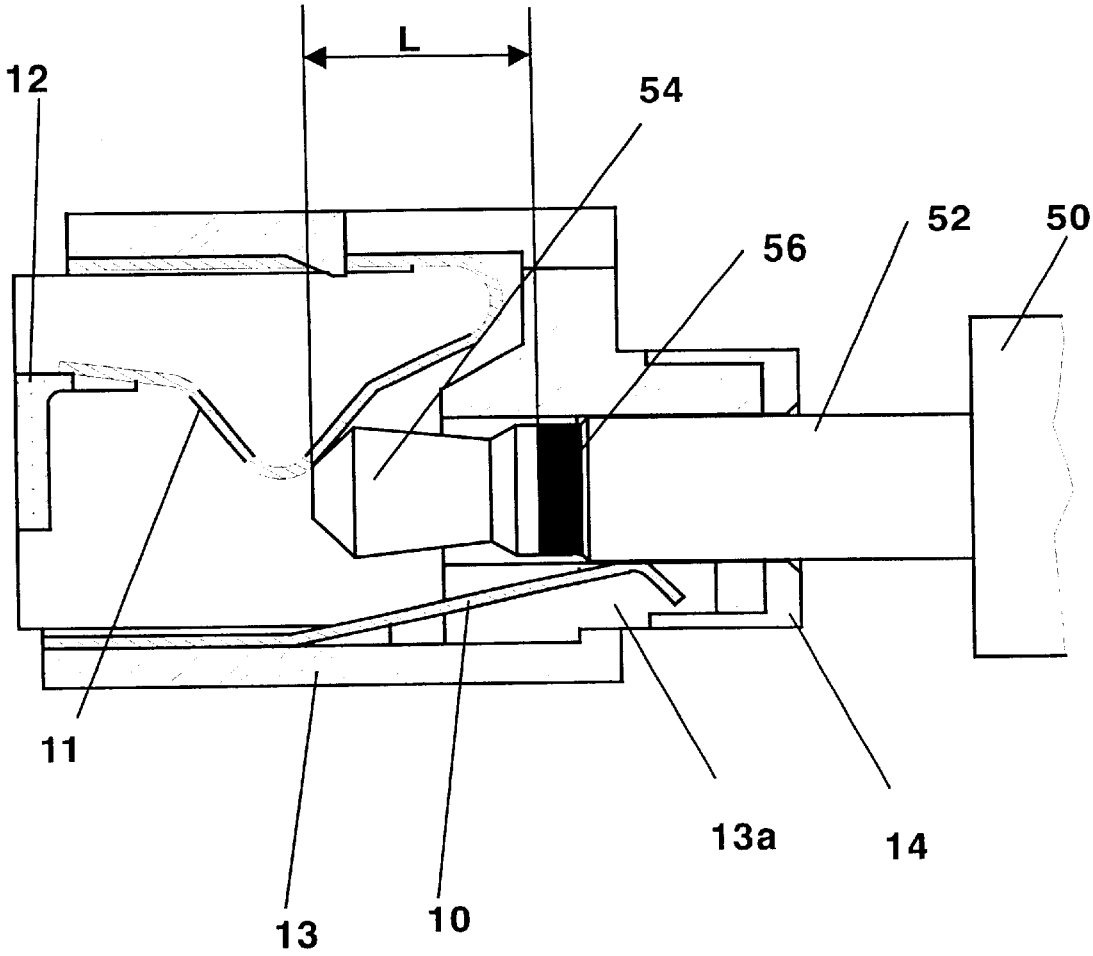
FIG. 5 is an enlarged cross-sectional view of the jack device for supplying DC power indicating a state in the middle of inserting a plug.

Referring to FIG. 5, a description will be given on the motion of insertion of single-head plug 50 into jack section 3 to a predetermined depth.

When single-head plug 50 having plural (two, for example) plug poles is pushed in, the following motion will occur.

1. First, plug pole 54, namely, first plug pole disposed at the front end of plug 50, is brought into contact with grounding spring 10.
2. Upon further pushing, grounding spring 10 is pushed down by plug pole 54 toward notch 13*a*.
3. Upon further pushing, contact between plug pole 54 and grounding spring 10 is released, and grounding spring 10 is brought into contact with insulating collar 56.
4. Upon further pushing, the contact between grounding spring 10 and insulating collar 56 of plug 50 is released, and grounding spring 10 is brought into contact with plug pole 52, namely, second plug pole.
5. Upon further pushing, movable contact piece 11 is brought into contact with plug pole 54.

In the above motion of inserting single-head plug 50 into jack section 3 to a predetermined depth, the sequence of motion 4 and motion 5 may be reversed.

As has been described above, by the time plug pole 54 is brought into contact with movable contact piece 11, plug pole 54 has already passed contacting portion 10*p* of grounding spring 10. Accordingly, plug pole 54 will never be simultaneously brought into contact with grounding spring 10 and movable contact piece 11. In other words, grounding spring 10 and movable contact piece 11 will never make a short circuit through plug pole 54. Consequently, no overcurrent will flow to a DC power supply unit of an apparatus or device connected through cable 6. Therefore, no malfunction due to an overcurrent will be caused in an apparatus or device that is connected to a jack device of the present invention.

As has been described above, by the time plug pole 54 is brought into contact with movable contact piece 11, plug pole 54 has already passed contacting portion 10*a* of grounding spring 10. Accordingly, plug pole 54 will never be simultaneously brought into contact with grounding spring 10 and movable contact piece 11. In other words, grounding spring 10 and movable contact piece 11 will never make a short circuit through plug pole 54. Consequently, no overcurrent will flow to a DC power supply unit of an apparatus or device connected through cable 6. Therefore, no malfunction due to an overcurrent will be caused in an apparatus or device that is connected to a jack device of the present invention.

Furthermore, in this preferred embodiment, grounding spring 10, being one of the contact pieces, is deformed due to inserted plug 50 in a manner such that its contacting portion 10*a* departs from the other movable contact piece 11. As a result, the spacing D between contacting portion 10*a* of grounding spring 10 and contacting portion 11*a* of movable contact piece 11 is further widened from that before insertion. Consequently, the jack device in accordance with the present invention further assures prevention of a short circuit.

Figure 10:
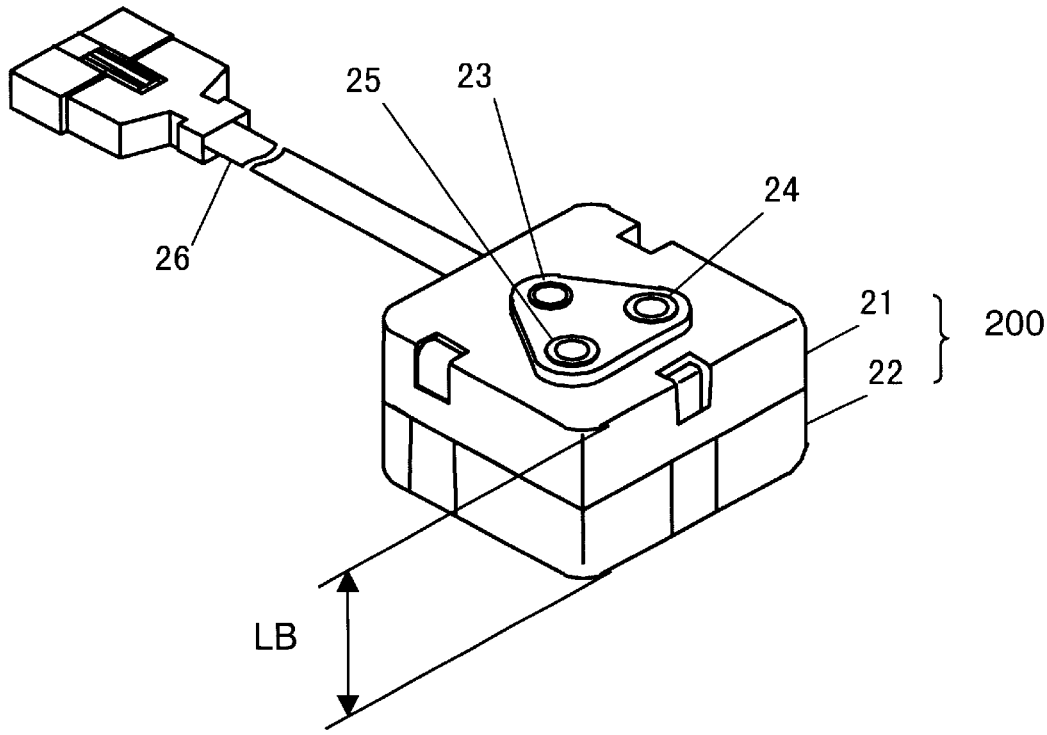
FIG.10 (PRIOR ART)
FIG. 10 is an external perspective view of a conventional jack device.
Figure 11:
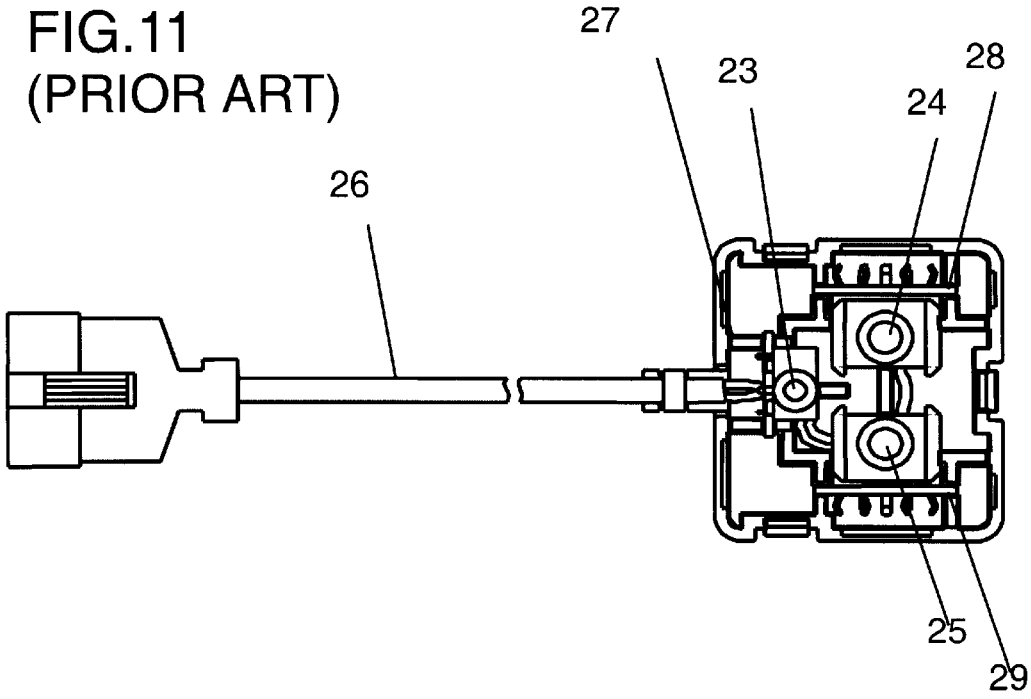
FIG.11 (PRIOR ART)
FIG. 11 is a plan view of the above conventional jack device with the upper case removed to show the inside.

In a conventional jack device as shown in FIG. 12, when the spacing DB between contacting portions 30*a* and 31*a* is widened, normally the dimension LB (ref. FIG. 10) increases though not illustrated. Therefore, the length of the plug has to be made greater in accordance with the increase in the dimension LB.

However, according to the structure of the present invention, the spacing D between the two contact pieces is greater compared with the first plug pole. Accordingly, there will not occur any case in which these two contact pieces are simultaneously brought into contact with the first plug pole provided at the front end of a plug. Therefore, the two contact pieces will never make a short circuit through the first plug pole in the middle of insertion of a plug. Also, the outer dimensions LA of a jack device with the above structure can be made equal to the outer dimensions LB of a conventional jack device while preventing a short circuit of, the two contact pieces. As a result, a jack device in the present preferred embodiment can be used as is without making the length of a conventional plug greater.

For the above preferred embodiment, description of only jack section 3 for supplying DC power out of the, three jack sections (3, 4, 5) was given and its internal structure was shown. However, the other jack sections (4, 5) may be of the same structure. By employing this structure, a short circuit between grounding spring 10 and movable contact piece 11 through plug pole 54 at the front end of a plug can also be prevented in the other jack sections (4, 5).

In the above-described preferred embodiment, a description was made on a single-head plug having two plug poles in the direction of insertion as an example. Needless to say, however, the present invention may be embodied in a jack device in which a single-head plug having three or more (three, for example) plug poles in the direction of insertion is inserted for connection.

Preferred Embodiment—2

Figure 6:
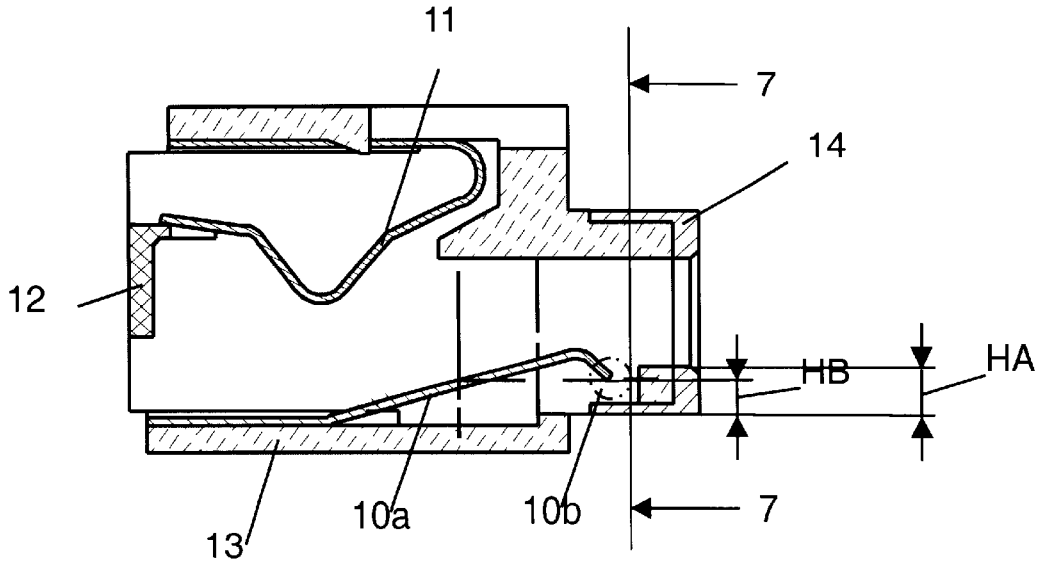
FIG. 6 illustrates a state of a jack device before insertion of a plug in a second preferred embodiment of the present invention.
Figure 7:
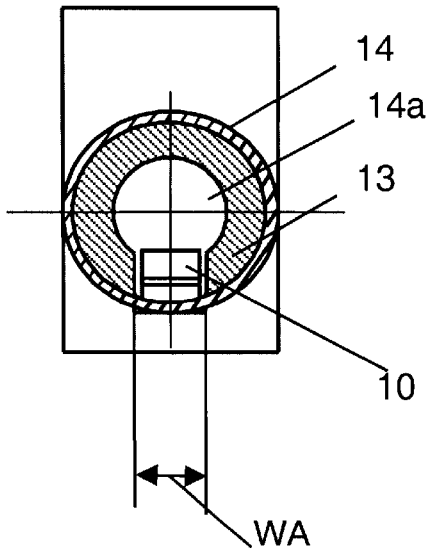
FIG. 7 is a cross-sectional view of the jack device in FIG. 6 taken along the plane 7—7.

Referring to FIG. 6 and FIG. 7, a description of a jack device in a second preferred embodiment of the present invention will be given below taking a jack section for supplying DC power as an example. FIG. 6 shows a state before insertion of a plug of a jack device in a second preferred embodiment of the present invention. FIG. 7 is a cross-sectional view of a jack device of FIG. 6 taken along the plane 7—7. The jack device in the second preferred embodiment is basically of the same structure as the jack device in the first preferred embodiment as shown in FIGS. 1 to 5.

The point of difference from the jack device in the first preferred embodiment lies in that the position of the front end lob of grounding spring 10 as shown in FIG. 6 is at notch 13*a*. Namely, assuming that the height of both sides of notch 13*a* as shown in FIGS. 6 and 7 to be HA, and the height of the position of the front end 10*b* of grounding spring 10 to be HB, this jack device satisfies a positional relationship of $$HA \geq HB.$$

Both sides of notch 13*a* work as guides for grounding spring 10 while it is being bent downward due to insertion of a plug. This structure allows smooth downward bending of grounding spring 10 due to insertion of a plug.

Figure 8:
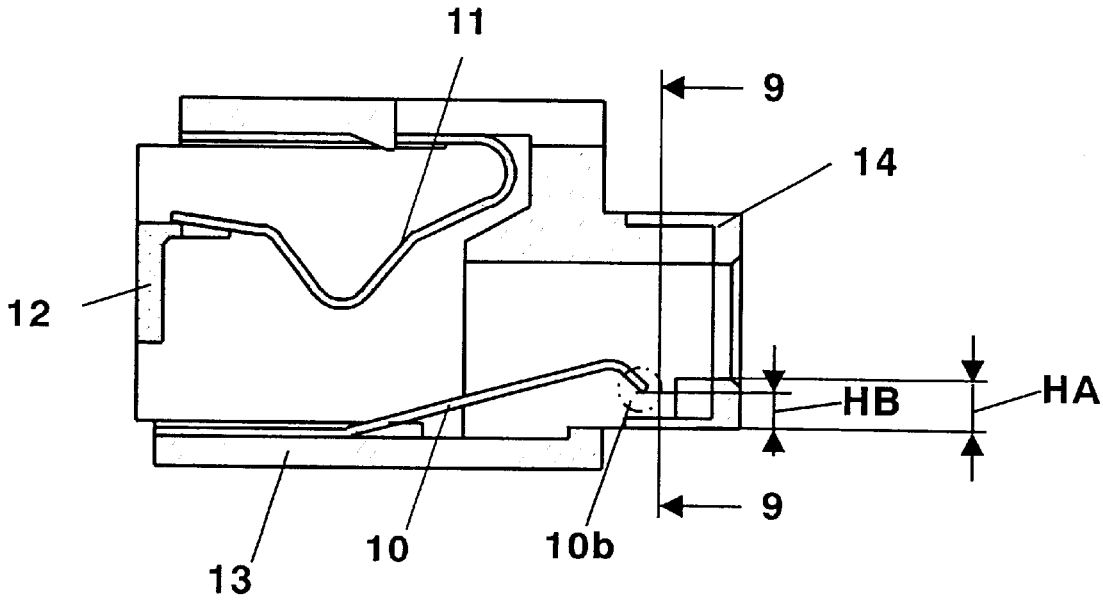
FIG. 8 illustrates a state of a jack device before insertion of a plug in another example of the second preferred embodiment.
Figure 9:
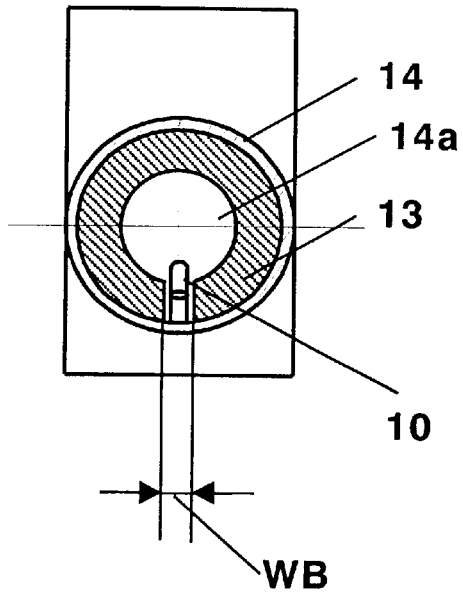
FIG. 9 is a cross-sectional view of the jack device in FIG. 8 taken along the plane 9—9.

FIG. 8 is an illustration of another example of a jack device in the second preferred embodiment. FIG. 9 is a cross-sectional view of the jack device of FIG. 8 taken along the plane 9—9. The jack devices illustrated in FIG. 8 and FIG. 9 are basically of the same structure as the jack devices illustrated in FIG. 6 and FIG. 7. The point of difference from the jack devices of FIG. 6 and FIG. 7 is that, while grounding springs 10 shown in FIG. 6 and FIG. 7 are a flat plate, the grounding springs of the jack devices of FIG. 8 and FIG. 9 are a wire spring, which allows the width WB of a notch shown in FIG. 9 to be made smaller than the notch width WA of the jack devices illustrated in FIG. 6 and FIG. 7. This structure allows smooth downward bending of grounding spring 10 due to insertion of a plug. Furthermore, as the notch width of the jack devices illustrated in FIG. 8 and FIG. 9 is smaller, there is less play between a plug and the jack devices.

INDUSTRIAL APPLICABILITY

In a jack device in accordance with the present invention, the spacing between two contact pieces of the jack device is greater than the length of the first plug pole. Accordingly, these two contact pieces will not be simultaneously brought into contact with the first plug pole provided at the front end of a plug. Consequently, there will not occur any case in which the two contact pieces will make a short circuit through the first plug pole in the middle of insertion of a plug. Also, the outer dimensions of a jack device having this structure can be made equal to the outer dimensions of a conventional jack device while being able to prevent a short circuit of the two contact pieces. As a result, the jack devices of the present preferred embodiments can be used for a conventional plug as is without making its length longer.

Therefore, the present invention enables prevention of suspension of operation and malfunction of an apparatus or a device connected to the jack device due to an overcurrent.

What is claimed is:

1. A jack device having a jack section into which a single-head plug having plural plug poles in the direction of insertion is to be inserted, wherein the jack section comprises:

an elastically deformable first contact piece that is brought into contact with a first plug pole disposed at the front end of said plug;

an elastically deformable second contact piece that is brought into contact with a second plug pole disposed adjacently to said first plug pole; and a hollow holder for affixing said first contact piece and said second contact piece in the direction of insertion of a plug, said hollow holder having a notch formed for avoiding at least said second contact piece;

and the spacing between said first contact piece and said second contact piece of said jack section is made equal to or greater than the length of said first plug pole in the direction of plug insertion, wherein a portion of said first contact piece overlaps a portion of said second contact piece when viewing a cross-section of said jack section taken along the direction of plug insertion.

2. A jack device having a jack section into which a single-head plug having plural plug poles in the direction of insertion is to be inserted, wherein the jack section comprises:

an elastically deformable first contact piece that is brought into contact with a first plug pole disposed at the front end of said plug;

an elastically deformable second contact piece that is brought into contact with a second plug pole disposed adjacently to said first plug pole; and a hollow holder for affixing said first contact piece and said second contact piece in the direction of insertion of a plug, said hollow holder having a notch formed for avoiding at least said second contact piece;

and the spacing between said first contact piece and said second contact piece of said jack section is made equal to or greater than the length of said first plug pole in the direction of plug insertion, and, additionally, contacting portion of said first contact piece of said jack section is deformable by insertion of a plug in a direction departing from said second contact piece, wherein a portion of said first contact piece overlaps a portion of said second contact piece when viewing a cross-section of said jack section taken along the direction of plug insertion.

3. The jack device of claim 1 or claim 2, wherein the height HA of both sides of said notch of said jack section and the height HB of the position of the front end of said second contact piece satisfy the relationship:

$$HA \geq HB.$$

4. The jack device of claim 3, wherein said second contact piece of said jack section is made of a wire spring.

5. The jack device of any of claims 1 to 4 having a plurality of jack sections into which a plug is to be inserted for connection, wherein at least one of the jack sections is adaptable with a single-head plug having plural plug poles in the direction of insertion.

6. The jack device of claim 5, wherein one of said jack sections is for supplying DC power.

7. The jack device of claim 5 comprising:

a jack section for supplying DC power through a single-head plug having plural plug poles in the direction of insertion; and two jack sections for left and right audio channels: and allowing use for a headphone.

8. The jack device of claim 1 or claim 2, wherein said hollow holder defines a first passage and a reduced-diameter second passage extending from said first passage, said reduced-diameter second passage having an entrance end for receiving the plug from outside said jack section.

9. The jack device of claim 8, wherein said notch is formed in a portion of said hollow holder adjacent said reduced-diameter second passage.

10. The jack device of claim 1 or claim 2, wherein a portion of said second contact piece is arranged so as to be moveable into said notch.

11. The jack device of claim 10, wherein said hollow holder defines a first passage and a reduced-diameter second passage extending from said first passage, said reduced-diameter second passage having an entrance end for receiving the plug from outside said jack section.

12. The jack device of claim 11, wherein said notch is formed in a portion of said hollow holder adjacent said reduced-diameter second passage.

* * * * *